US011251537B2

(12) United States Patent
Sciancalepore et al.

(10) Patent No.: US 11,251,537 B2
(45) Date of Patent: Feb. 15, 2022

(54) RECONFIGURABLE INTELLIGENT SURFACE-BASED SYSTEMS AND METHODS FOR MANAGING MULTIPLE WIRED CONNECTIONS IN WIRELESS DATA CENTERS

(71) Applicant: NEC Laboratories Europe GmbH, Heidelberg (DE)

(72) Inventors: Vincenzo Sciancalepore, Heidelberg (DE); Andres Garcia Saavedra, Madrid (ES); Xavier Costa Perez, Heidelberg (DE)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 16/892,309

(22) Filed: Jun. 4, 2020

(65) Prior Publication Data

US 2021/0384637 A1 Dec. 9, 2021

(51) Int. Cl.
*H01Q 15/14* (2006.01)

(52) U.S. Cl.
CPC ..... *H01Q 15/148* (2013.01)

(58) Field of Classification Search
CPC ..... H01Q 15/148; G06F 16/211; G06F 16/27; G06F 16/282; G06F 16/9024
See application file for complete search history.

(56) References Cited

U.S. PATENT DOCUMENTS 7,938,700 B2 5/2011 Jacks et al.
10,452,623 B2 10/2019 Nivala et al.
2002/0122388 A1* 9/2002 Behbehani ..... H04L 41/0823 370/238
2012/0126149 A1* 5/2012 Cobo ..... H01Q 15/148 250/505.1
2019/0044246 A1 2/2019 Pitsillides et al.
2021/0243782 A1* 8/2021 Miao ..... H04W 72/14

OTHER PUBLICATIONS

Suto, Katsuya et al. "A Failure-Tolerant and Spectrum-Efficient Wireless Data Center Network Design for Improving Performance of Big Data Mining," in Proc. IEEE 81st Veh. Technol. Conf. (VTC), May 2015.

(Continued)

*Primary Examiner* — Daniel Munoz
(74) *Attorney, Agent, or Firm* — Leydig, Voit & Mayer, Ltd.

(57) ABSTRACT

Systems and methods for dynamically controlling connections between a plurality of servers in a data center, where the data center includes at least a first reconfigurable intelligent surface (RIS) and a first RIS controller (RISC) configured to control physical propagation settings of physical propagation elements of the first RIS, wherein each server of the plurality of servers includes or is communicably connected with a wireless connection component enabling communication via directive wireless propagation via the physical propagation elements of the first RIS. A controller device pushes a set of one or more RIS configurations to the RIS and a set of one or more transceiver beamforming configurations to the wireless connection components and jointly determines an optimal transceiver beamforming configuration and an optimal RIS configuration using the connection feedback information.

15 Claims, 9 Drawing Sheets

(56) References Cited

OTHER PUBLICATIONS

Kandula, Srikanth et al. "Flyways to De-Congest Data Center Networks," in Proc. ACM Hotnets—VIII, Oct. 2009, pp. 202-208.
Zhou, Xia et al. "Mirror mirror on the Ceiling: Flexible Wireless Links for Data Centers," in Proc. ACM SIGCOMM'12, Aug. 13-17, 2012.
Shin, Ji-Yong et al. "On the Feasibility of Completely Wireless Datacenters," IEEE Trans. Netw., vol. 21, No. 5, Oct. 2013.
Cui, Yong et al. "Diamond: Nesting the Data Center Network with Wireless Rings in 3D Space," IEEE Trans. Netw., vol. 26, No. 1, pp. 145-160, Feb. 2018.
Faisal, Alice et al., "Ultra-Massive MIMO Systems at Terahertz Bands: Prospects and Challenges," arXiv:1902.11090v3, Oct. 7, 2019.
Hamedazimi, Navid et al., "FireFly: A Reconfigurable Wireless Data Center Fabric Using Free-Space Optics," ACM, SIGCOMM'14, Aug. 17-22, 2014.
Renzo, Marco et al. "Smart radio environments empowered by reconfigurable AI meta-surfaces: an idea whose time has come," EURASIP Journal on Wireless Communications and Networking, SpringerOpen, Dec. 5, 2019.
Yuan, Xiaojun et al. "Reconfigurable-Intelligent-Surface Empowered 6G Wireless Communications: Challenges And Opportunities," arXiv:2001.00364v1, Jan. 2, 2020.
Di Renzo, Marco, "Wireless system design and theory with reconfigurable intelligent surface (RIS) technology," Apr. 27-29, 2020.
Chowdhury, Mostafa Zaman et al. "6G Wireless Communication Systems: Applications, Requirements, Technologies, Challenges, and Research Directions," arXiv:1909.11315, submitted Sep. 25, 2019.
Taha, Abdelrahman et al. "Enabling Large Intelligent Surfaces With Compressive Sensing And Deep Learning," arXiv:1904.10136v2, Apr. 30, 2019.
Yuan, Yifei et al. "Potential Key Technologies for 6G Mobile Communications," Science China: Information Sciences, May 18, 2020.
Celik, Abdulkadir et al. "Wireless Data Center Networks: Advances, Challenges, and Opportunities,"arXiv:1811.11717v1, Nov. 28, 2018.
Tasolamprou, Anna C. et al. "Exploration Of Intercell Wireless Millimeter-Wave Communication in the Landscape of Intelligent Metasurfaces," IEEE Access, Sep. 12, 2019.
Samadi, Fereshteh and Sebak, Abdelrazik, "Reconfigurable Surface Design for Electromagnetic Wave Control," American Journal of Electronics & Communication, vol. I (1), 65-68, Nov. 2019.
Chaintoutis, Charidimos et al. "Free Space Intra-Datacenter Interconnects Based on 2D Optical Beam Steering Enabled by Photonic Integrated Circuits," MDPI Photonics 2018, 5(3), 21, Aug. 1, 2018.
Ramachandran, Kishore et al. "60 GHz Data-Center Networking: Wireless = Worry less?," Jul. 14, 2008.
Nadeem, Qurrat-Ul-Ain et al. "Asymptotic Max-Min SINR Analysis of Reconfigurable Intelligent Surface Assisted MISO Systems," arXiv:1903.08127v3, Dec. 6, 2019.
Hamedazimi, Navid et al. "Patch Panels in the Sky: A Case for Free-Space Optics in Data Centers," ACM, Hotnets'13, Nov. 21-22, 2013.
Suto, Katsuya et al. "A failure-tolerant and spectrum-efficient wireless data center network design for improving performance of big data mining," in Proc. IEEE 81st Veh. Technol. Conf. (VTC), May 2015, Abstract.

* cited by examiner

RECONFIGURABLE INTELLIGENT SURFACE-BASED SYSTEMS AND METHODS FOR MANAGING MULTIPLE WIRED CONNECTIONS IN WIRELESS DATA CENTERS

FIELD

Embodiments relate to reconfigurable intelligent surface (RIS) systems and methods, and in particular methods and systems managing wireless data centers using RIS-based systems and methods.

BACKGROUND

Data is generally managed and stored within IT equipment placed into data centers. Data centers include network switches and tools, servers containing data and other facilities to make efficient use of space, maintain a proper airflow and provide easy access to human operators in case of failures or maintenance operations.

Due to a high concentration of servers and equipment, the servers and related equipment are usually stacked in racks, which are typically placed in rows and are interconnected with cables. As per common structure, a rack may include a few mounting rails within a supporting framework. Aluminum or steel rails may support weight of a heavy equipment with a standard length and width for each rack unit (e.g., 19-inches wide and 1.75-inches high as specified by the Electronics Industry Alliance (EIA) and by the Electronic Components Industry Association (ECIA)).

When considering rack cabinets, the cabinet may be provided with front and rear doors along with side panels. However, on the front side several Ethernet cables are typically placed to provide connectivity among different servers installed on the rack units and other devices such as an Ethernet switch or hub, a patch panel and a KVM (keyboard, video and mouse) switch to live control a single server within the rack. In addition, Ethernet cables are used to interconnect different racks with patch panels installed on the ceiling.

Although wired connections guarantee reliability and ultra high-capacity, a proper patching might require a long installation and configuration time. Connecting a large number of rack servers is a demanding engineering task prone to human error, and may be overly expensive. In particular, when a new server is installed (or an existing server is replaced), operators need to physically identify the connection Ethernet cable(s), remove the cable(s) and install or replace the server. Additionally, when a different configuration is required (e.g., a network topology change is needed) a specific patching must be applied (e.g., by a human operator) to avoid unexpected behavior. Finally, racks typically cannot be moved as they are physically connected to the ceiling patch panel to provide inter-connection between different racks. As a result, physical network connectivity via wires becomes a cumbersome solution for the connectivity across servers and racks in a data center.

SUMMARY

The present invention provides systems and method for dynamically controlling connections between a plurality of servers in a data center, where the data center includes at least a first reconfigurable intelligent surface (RIS) and a first RIS controller (RISC) configured to control physical propagation settings of physical propagation elements of the first RIS, wherein each server of the plurality of servers includes or is communicably connected with a wireless connection component enabling communication via directive wireless propagation via the physical propagation elements of the first RIS. The method includes the steps, implemented in a control component (e.g., controller device), of: pushing a set of one or more RIS configurations to the RISC to enable the RISC to control physical propagation settings of the physical propagation elements of the RIS according to the one or more RIS configurations; pushing a set of one or more transceiver beamforming configurations to the wireless connection components to enable control of directive wireless propagation settings of the wireless connection components according to the one or more transceiver beamforming configurations; receiving connection feedback information from the wireless connection components for each of the one or more RIS configurations combined with each of the one or more transceiver beamforming configurations; determining an optimal transceiver beamforming configuration and an optimal RIS configuration using the connection feedback information; pushing the optimal RIS configuration to the RISC to enable the RISC to control the physical propagation settings of the physical propagation elements of the RIS according to the optimal RIS configuration; and pushing the optimal transceiver beamforming configuration to the wireless connection components to control the propagation settings of the wireless connection components according to the optimal transceiver beamforming configuration.

BRIEF DESCRIPTION OF THE DRAWINGS

Embodiments of the present invention will be described in even greater detail below based on the exemplary figures. The invention is not limited to the exemplary embodiments. All features described and/or illustrated herein can be used alone or combined in different combinations in embodiments of the invention. The features and advantages of various embodiments will become apparent by reading the following detailed description with reference to the attached drawings which illustrate the following.

DETAILED DESCRIPTION

Figure 1:
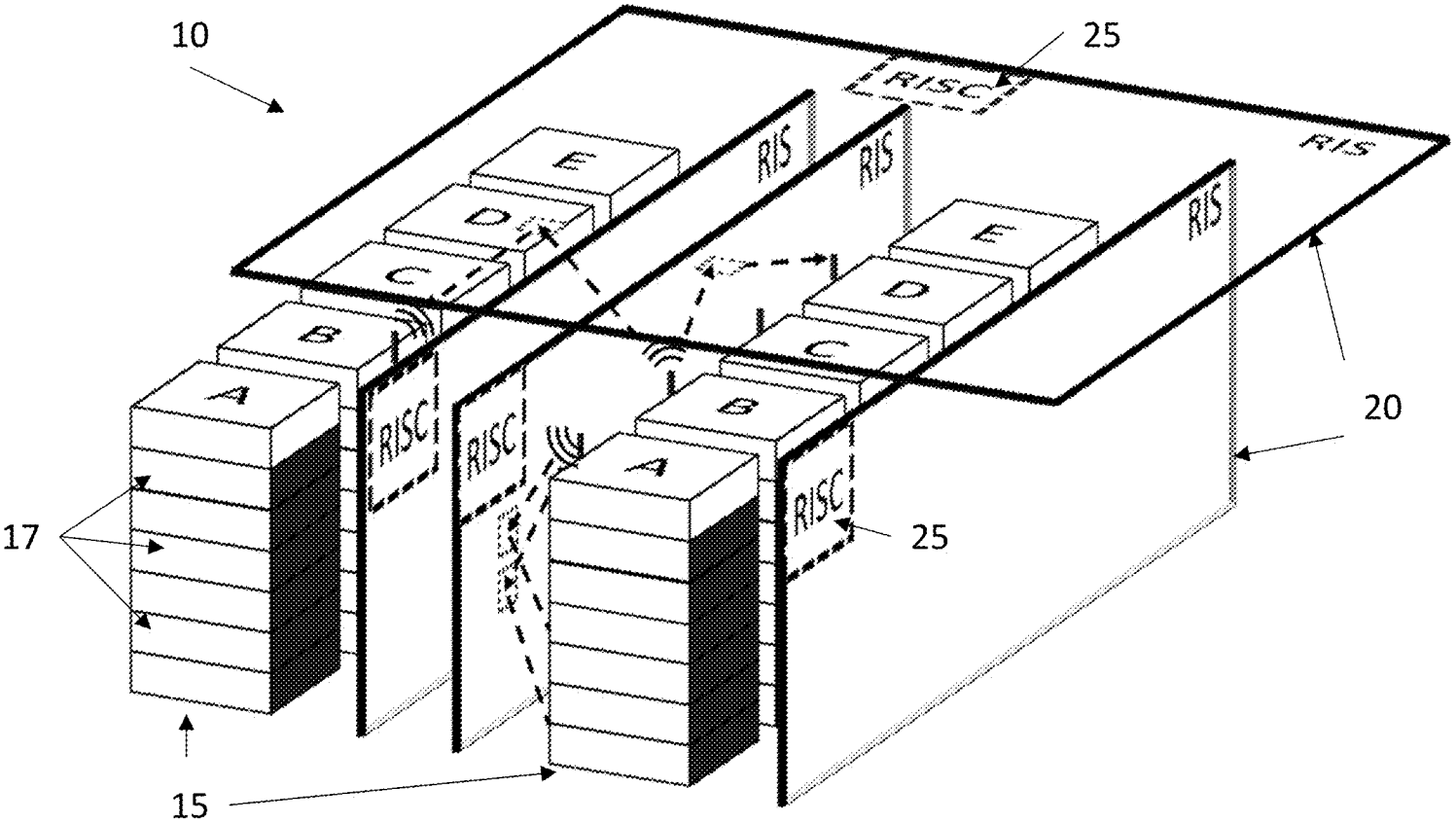
FIG. 1 illustrates an example data center configuration including RIS-based connectivity according to an embodiment.

Accordingly, it is desirable to provide improved systems and methods for managing data centers, and particularly managing inter-rack connections and intra-rack connections in a manner that easily and automatically adapts to topology changes and equipment failures.

Embodiments of the invention provide systems and methods that exploit reconfigurable intelligent surfaces (RISs) to dynamically and remotely control directive wireless communication links (such as TeraHertz or mmWave technologies) between different servers within a single rack (intra-rack connection management) and between different racks (inter-rack connection management). The RISs may be placed on the rear panel of the racks as well as walls and ceilings. Given the daunting complexity of setting-up and controlling such a system (which may include thousands of reconfigurable intelligent surfaces), in an embodiment, artificial-intelligence or machine-learning is used to automate the multiple processes required in a systematic manner. The embodiments advantageously enable an unprecedented level of automation in the configuration or re-configuration of data centers, as well as resilience to hardware failures and upgrades.

A RIS is, in an embodiment, a continuous meta-surface that can be modeled, e.g., as a grid of discrete unit cells spaced at sub-wavelength distance that can alter their electromagnetic response passively (without energy-consuming active electronics), such as phase, amplitude, polarization and frequency in a programmable manner (e.g., using a RIS controller). For instance, a RIS can be tuned such that signals bouncing off a RIS are combined constructively to increase signal quality at the intended receiver or destructively to avoid leaking signals to undesired receivers. As a result, a RIS applies controllable transformations into impinging radio waves without leveraging on power amplifiers or other active electronics, creating a host of opportunities for the optimization of wireless systems. Differently to MIMO transceivers or relays, which use active electronics to perform (active) beamforming or to relay signals using feedback from the transmitters or receivers, RISs perform passive beamforming without explicit feedback from the transceivers. RISs are also known as IRSs (Intelligent Reflecting Surfaces). The term passive is used herein to indicate that RISs provide no feedback to the transmitters or receivers regarding a received signal in an embodiment. However, RISs require power to dynamically modify their shape and electromagnetic (EM) propagation characteristics as needed.

According to an embodiment, a method of dynamically and adaptively controlling connections between a plurality of servers in a data center is provided, where the data center includes at least a first reconfigurable intelligent surface (RIS) and a first RIS controller (RISC) configured to control physical propagation settings of physical propagation elements of the first RIS, wherein each server of the plurality of servers includes or is communicably connected with a wireless connection component enabling communication via directive wireless propagation via the physical propagation elements of the first RIS. The method includes the steps, implemented in a control component (e.g., controller device), of: pushing a set of one or more RIS configurations to the RISC to enable the RISC to control physical propagation settings of the physical propagation elements of the RIS according to the one or more RIS configurations; pushing a set of one or more transceiver beamforming configurations to the wireless connection components to enable control of directive wireless propagation settings of the wireless connection components according to the one or more transceiver beamforming configurations; receiving connection feedback information from the wireless connection components for each of the one or more RIS configurations combined with each of the one or more transceiver beamforming configurations; determine an optimal transceiver beamforming configuration and an optimal RIS configuration using the connection feedback information; pushing the optimal RIS configuration to the RISC to enable the RISC to control the physical propagation settings of the physical propagation elements of the RIS according to the optimal RIS configuration; and pushing the optimal transceiver beamforming configuration to the wireless connection components to control the propagation settings of the wireless connection components according to the optimal transceiver beamforming configuration.

According to an embodiment, a machine learning algorithm is executed using the connection feedback information to jointly determine the optimal transceiver beamforming configuration and the optimal RIS configuration.

According to an embodiment, each wireless connection component may include a set of one or more antenna elements enabling the directive propagation. In an embodiment, the directive propagation may be implemented using mmWave transmission or other wireless transmission modality.

According to an embodiment, the plurality of physical propagation elements of an RIS include a plurality of reflective elements. In an embodiment, the physical propagation settings include reflection angles of the plurality of reflective elements. In an embodiment, the reflective elements are individually addressable or activatable, e.g., to adjust the reflection angle of the activated or addressed reflective element.

According to an embodiment, each of the plurality of servers is located in a same rack, wherein the first RIS is connected with a rear panel of the rack and wherein each server includes one of the wireless connection components. For example, each server may be integrated with a wireless connection component.

In an embodiment, each wireless connection component includes a transceiver component configured to transmit and receive wireless signals.

According to an embodiment, the plurality of servers may be located in multiple racks, wherein the first RIS is located proximal to the multiple racks, e.g., on the ceiling above the multiple racks or elsewhere in proximity to the multiple racks. In an embodiment, each rack of the multiple racks includes one or more of the plurality of servers, wherein each rack of the multiple racks includes one of the wireless connection components and wherein each of the one or more of the plurality of servers within the rack are communicably connected with the one of the wireless connection components. In an embodiment, each server in the rack may also be integrated with or communicably coupled with a separate wireless connection component to enable wireless communication with the one of the wireless connection components.

According to an embodiment, each rack of the multiple racks may include a second RIS and a second RISC configured to control physical propagation settings of physical propagation elements of the second RIS.

According to an embodiment, a first one of the wireless connection components acts as a master wireless connection component and the remaining wireless connection components act as slave wireless connection components, wherein the master wireless component includes or is communicably coupled with the control component. For example, the control component may be integrated into, or communicably coupled with, a master wireless component such as a master switch or hub device in one of the racks.

According to an embodiment, wherein a binary activation matrix is considered, the pushing of the set of one or more RIS configurations to the RISC includes initially pushing an initial RIS configuration wherein all physical propagation elements of the RIS are activated. Alternatively, when a more complex activation settings matrix is considered, the initial RIS configuration may include the simultaneous activation of all propagation directions, like an isotropic propagation. Remaining pushed RIS configurations may include any permutation of the physical propagation elements of the RIS being activated. For example, the set of pushed RIS configurations may include all possible permutations or a subset of all possible permutations.

According to an embodiment, a data center system is provided that includes a plurality of servers; at least a first reconfigurable intelligent surface (RIS) comprising physical propagation elements, at least a first RIS controller (RISC) configured to control physical propagation settings of the physical propagation elements of the first RIS; a plurality of wireless connection components, wherein each server of the plurality of servers includes or is connected with one of the plurality of wireless connection components enabling communication via directive wireless propagation via the physical propagation elements of the first RIS; and a controller device configured to: push a set of one or more RIS configurations to the RISC to enable the RISC to control physical propagation settings of the physical propagation elements of the RIS according to the one or more RIS configurations; push a set of one or more transceiver beamforming configurations to the plurality of wireless connection components to enable control of directive wireless propagation settings of the plurality of wireless connection components according to the one or more transceiver beamforming configurations; receive connection feedback information from the plurality of wireless connection components for each of the one or more RIS configurations combined with each of the one or more transceiver beamforming configurations; determine an optimal transceiver beamforming configuration and an optimal RIS configuration using the connection feedback information; push the optimal RIS configuration to the RISC to enable the RISC to control physical propagation settings of the physical propagation elements of the RIS according to the optimal RIS configuration; and push the optimal transceiver beamforming configuration to the plurality of wireless connection components to control propagation settings of the plurality of wireless connection components according to the optimal transceiver beamforming configuration.

According to an embodiment, a controller device is provided in a data center for dynamically controlling connections between a plurality of servers in the data center. The controller device includes a memory storing code, which when executed by one or more processors of the controller device cause the controller device to implement a method of dynamically controlling connections between a plurality of servers in a data center as described herein. In an embodiment, a controller device may be implemented as a patch panel in a rack.

According to an embodiment, a tangible, non-transitory computer-readable medium is provided that has instructions thereon which, upon being executed by one or more processors, alone or in combination, provide for execution of any method described herein, such as, for example, a method of dynamically controlling connections between a plurality of servers in a data center as described herein.

FIG. 1 illustrates an example configuration of a data center 10 including RIS-based connectivity according to an embodiment. The data center 10 includes multiple racks 15 (each rack labelled as "A", "B", "C", "D", and "E" in FIG. 1), e.g., multiple regularly placed racks. Each rack 5 may include a rack housing or cabinet with a set of one or more rack units or slots 17 for allocating servers, KVM switches, patching panels and wireless switches or hubs and other devices. Rack cabinets may be equipped with a rear panel where a Reconfigurable Intelligent Surface (RIS) 20 might be installed. Alternatively, an RIS 20 might be installed in one or more walls. Each RIS may be directly controlled by an associated RIS Controller (RISC) 25. As shown in FIG. 1, the data center 10 may have multiple RISs 20, with each RIS 20 serving multiple racks 15 however, in an embodiment, a single rack may include a single RIS 20 (with associated RISC).

The RISs in FIG. 1 are depicted far from the rack cabinets to show reflections of directive propagation rays. However, in use, the RISs might be placed on the rear panels of rack cabinets.

Figure 2:
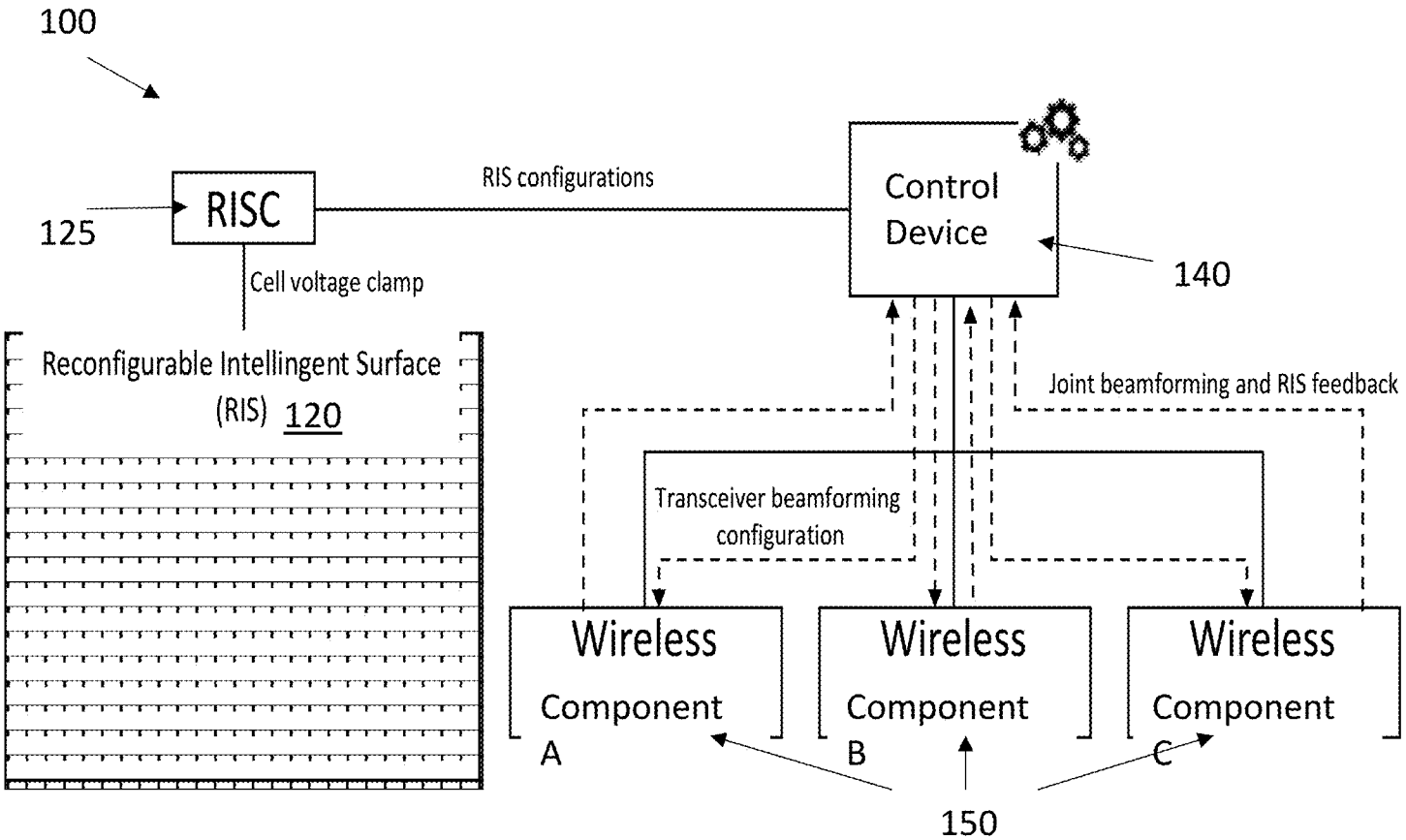
FIG. 2 illustrates a RIS control system architecture according to an embodiment.

FIG. 2 illustrates a RIS control system architecture 100 according to an embodiment. The RIS control system architecture 100 may be used to dynamically control intra-rack connections and/or inter-rack connections as discussed in more detail herein. For example, the RIS Controller (RISC) 125 may be configured to directly control the RIS 120 to change physical parameters on the surface to achieve different propagation settings. For example, the RISC 125 may control the RIS 120 to change physical propagation settings of physical propagation elements of the RIS. Physical propagation elements may include, in an embodiment, an array of reflective elements which may be individually addressed or activated based on control signals received from the RISC 125.

A RIS control device 140 is provided to control the RIS 120 (via RISC 125), to communicate with the wireless connection components 150 and to determine optimal configuration settings as will be described herein. The RIS control device 140 may be implemented in a patch panel on a rack, or in another component on a rack or communicably coupled with a rack. The RIS control device 140 includes at least two different types of interfaces: one interface allows to push different RIS propagation configurations onto the RIS 120 (e.g., by means of RISC 125 which in turn translates such configurations into physical propagation settings) and another interface allows to push transceiver beamforming configurations to wireless connection components 150 and to retrieve connection feedback information (e.g., instantaneous feedback information about the connection status) from the wireless connection devices 150.

A wireless connection component 150 may be implemented as a switch or hub for a rack, which provides wireless communication capabilities for communicating with similar switches or hubs on other racks and/or with RISCs for various RISs in the data center. Additionally, a wireless connection component 150 may be implemented as part of a server, e.g., provides wireless communication capability for the server to communicate with other severs in a rack and/or with a switch/hub of the rack. A wireless connection component will typically include a transceiver that allows for transmitting and receiving wireless signals as well as a processing component such as a microprocessor. The transceiver may include one or multiple (e.g., an array of) antenna elements to provide for directive wireless signal propagation and communication. The mmWave technology might be implemented to achieve such propagation properties.

Figure 3:
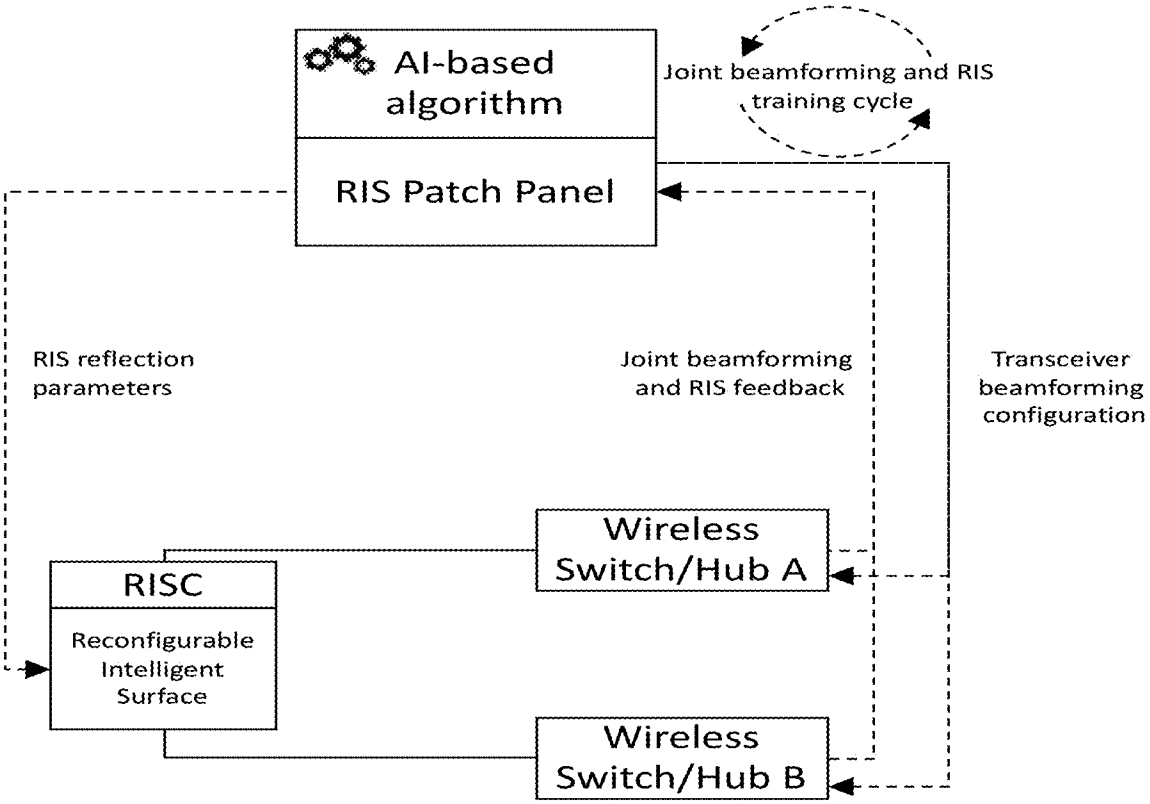
FIG. 3 illustrates joint AI-based RIS control and beamforming optimization according to an embodiment.

FIG. 3 illustrates an artificial intelligence (AI)-based joint RIS control and beamforming optimization process according to an embodiment. Advanced mechanisms can be implemented, such as AI-based algorithms that are executed on the control device (i.e., "RIS Patch Panel") as shown in FIG. 3. As an example, an AI algorithm may push an initial transceiver beamforming configuration on the wireless connection components (i.e., wireless switch/hubs A and B in FIG. 3) while concurrently instructing the RISC to configure the RIS with an initial configuration. In an embodiment, the initial configuration may be that all RIS cells are activated. Upon retrieving the beamforming feedback from the wireless connection components, the AI-based algorithm pushes additional RIS configurations and transceiver beamforming configurations and reduces the optimal solutions set so as to trigger a subset of TX/RX configurations to the wireless connection components, and, a specific RIS configuration may be sent to the RISC according to the current data center topology.

The present embodiments are applicable to controlling at least two different connection types i) an intra-rack connection, and ii) an inter-rack connection.

Figure 4:
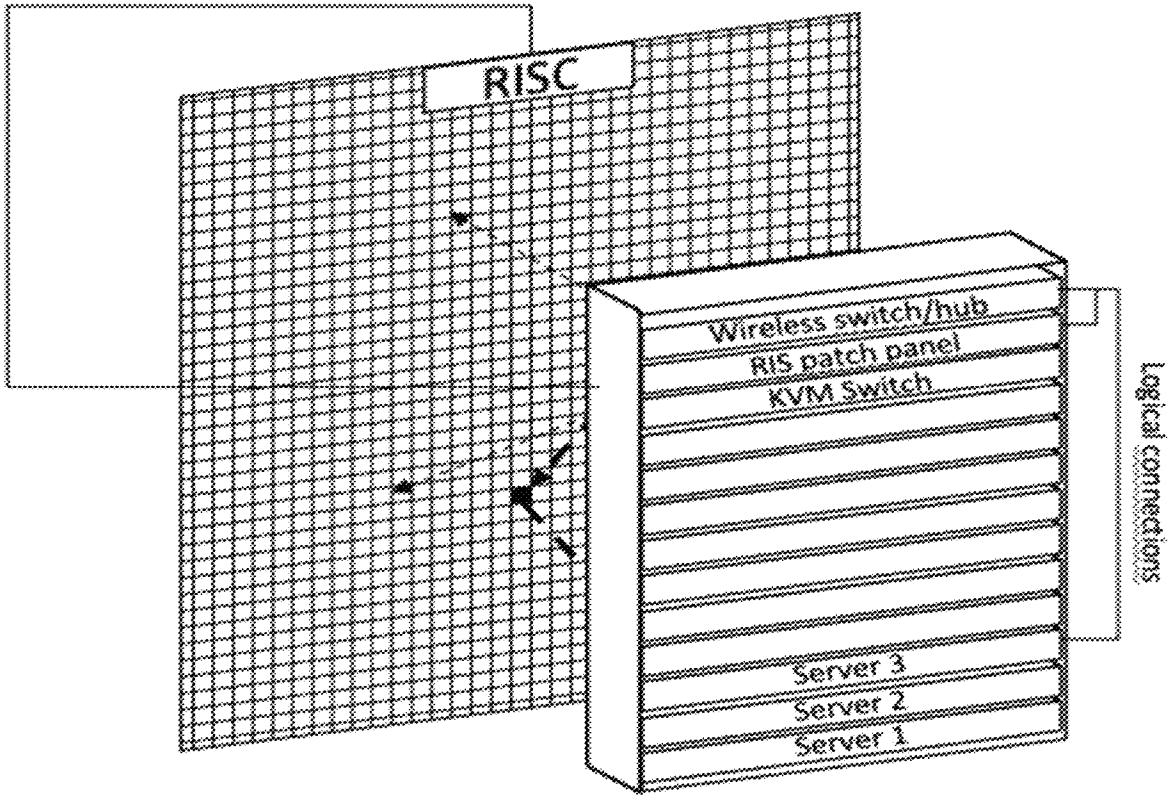
FIG. 4 illustrates an intra-rack configuration with servers in a rack that are wirelessly connected through RIS according to an embodiment.

In an intra-rack connection, each rack server is wirelessly connected to the Wireless switch/hub X placed within the same rack cabinet. FIG. 4 illustrates an example with servers in a rack that are wirelessly connected through a RIS to a control device (RIS patch panel in FIG. 4) via a Wireless switch/hub, according to an embodiment. This connection is established using directive propagation properties of the wireless propagation technology, e.g., mmWave (or Tera-Hertz) technology. For example, in an embodiment, each server includes or is communicably coupled with a wireless connection component (e.g., transceiver) that enables wireless communication for the server. In order to have a direct connection, the control device (RIS patch panel) configures the RIS by means of the RIS Controller (RISC) to enable a specific (set of) antenna elements with proper propagation settings. This would enable only one specific propagation direction while absorbing other scattered propagations thereby preventing the connection towards different directions, as shown in FIG. 4. Note that no feedback is provided by the RIS (as it is intended to be passive), instead feedback information on established connections are promptly sent by the servers' wireless connection components to the control device (RIS patch panel).

In an inter-rack connection, the connections between different racks may be obtained by means of a RIS 120 (as per FIG. 1) placed for example (but not limited to) on the ceiling or remotely from various racks. In an embodiment, a master-slave hierarchical structure may be implemented with a single wireless communication component (e.g., switch/hub) acting as master, i.e., the control device (e.g., switch/hub with RIS patch panel) within one rack can control the RISC of the ceiling/remote RIS, whereas all other wireless connection components (e.g., rack switches/hubs) act as slaves. The ceiling RIS is configured to create unique connection paths between different pairs of racks based on predefined configurations. Racks can be moved and inter-rack connections can be dynamically re-established as described herein.

Figure 5:
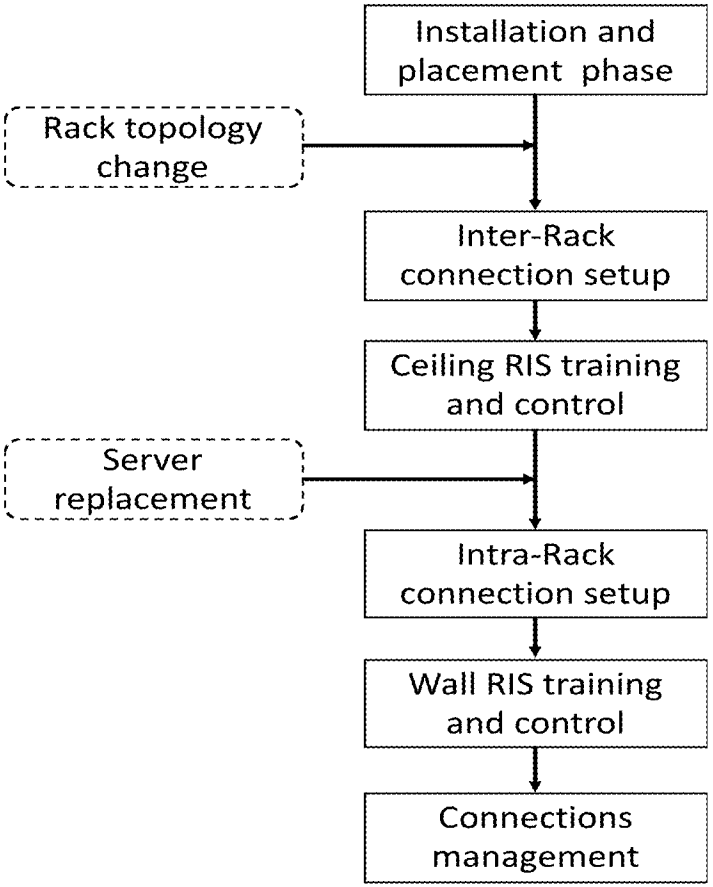
FIG. 5 illustrates a setup and control procedure for a RIS-based data center, according to an embodiment.

FIG. 5 illustrates a setup and control procedure for a RIS-based data center (RWDC), according to an embodiment. In an embodiment, after racks and servers have been positioned and installed, an Inter-rack RIS AI or machine learning (ML)-driven training and control process is implemented. This process helps the master control device to dynamically control the RISC when a different configuration, i.e., enabling different connections between racks, is pushed. If the topology of the racks changes, such a training process should be executed again. Once the inter-rack connections are established, an intra-rack RIS training and control process may be executed for each rack. This process allows each rack server to be interconnected based on a predefined configuration. It should be appreciated that one or more intra-rack RIS training processes may be implemented before or concurrently with the inter-rack training process.

Example Embodiment: Moving Racks with Dynamic Reconfiguration

Figure 6:
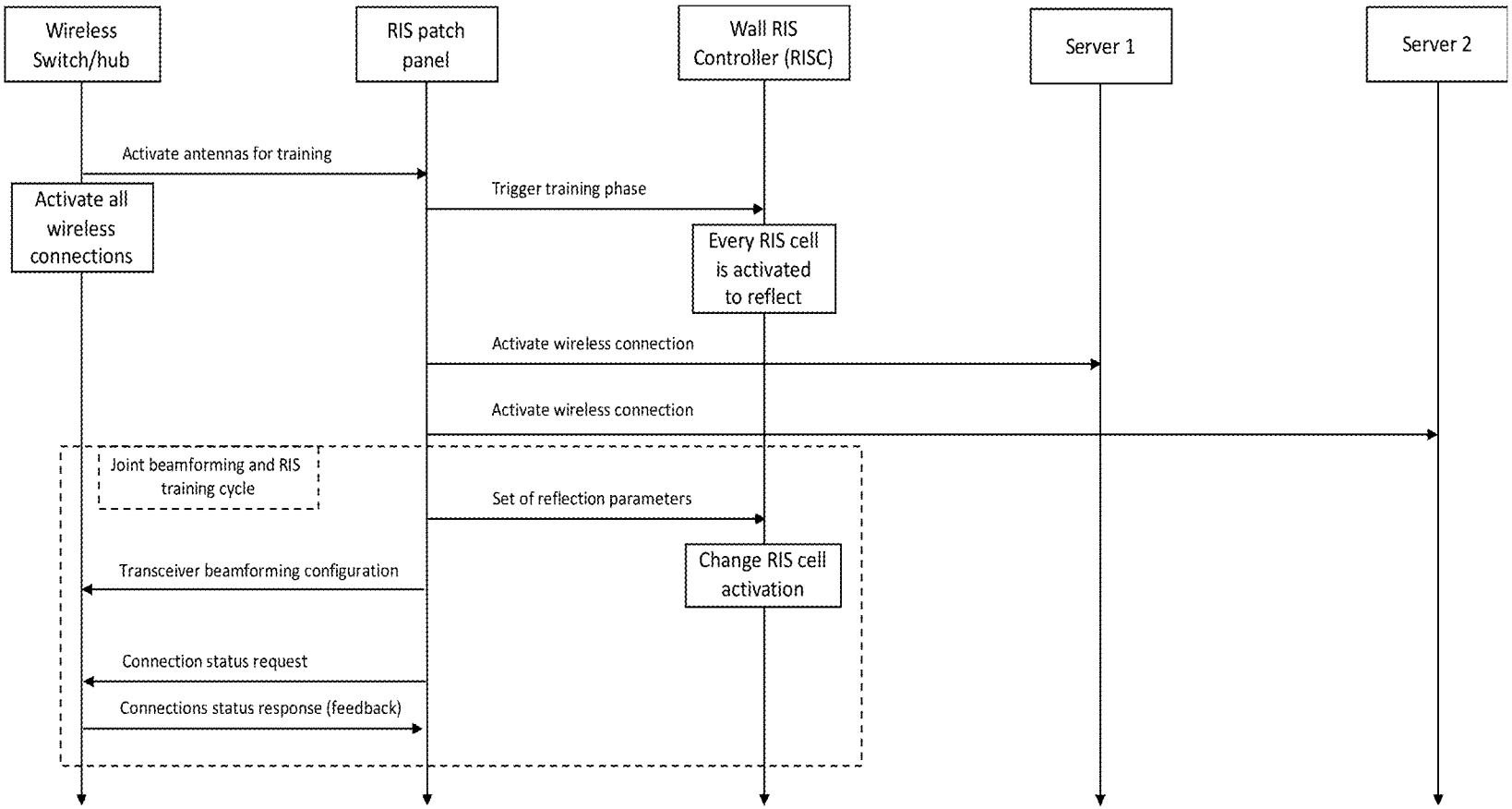
FIG. 6 illustrates a flow diagram of a ceiling RIS training and control process according to an embodiment.

In one embodiment, inter-rack RIS training and control may be executed to keep track of all possible positions of each rack. With the aid of a machine-learning-based algorithm, the control device (RIS patch panel) can automatically learn setting parameters to dynamically configure the RIS (by means of a RISC) when a rack is moved into a different position. FIG. 6 illustrates a flow diagram of a ceiling RIS training and control process according to an embodiment. As shown, Wireless Switch acting as master issues an Activation command to the control device (RIS patch panel) so as to enable the RIS to activate all antenna elements in order to be reflected. In addition, the control device issues an activation command to all other wireless switches (slaves) to start the training process. The control device can use a machine-learning-based algorithm to dynamically change the set of reflection parameters the RIS will use while obtaining the connections status from the Wireless Switch/hub. The Wireless switch/hub and control device may be directly connected through a cable, or placed within the same rack unit.

Once the training process is finished, the control device may dynamically change connections, i.e., interconnect or disconnect pairs of wireless switches, based on pushed configurations.

Example Embodiment: Automated Server Replacement

Figure 7:
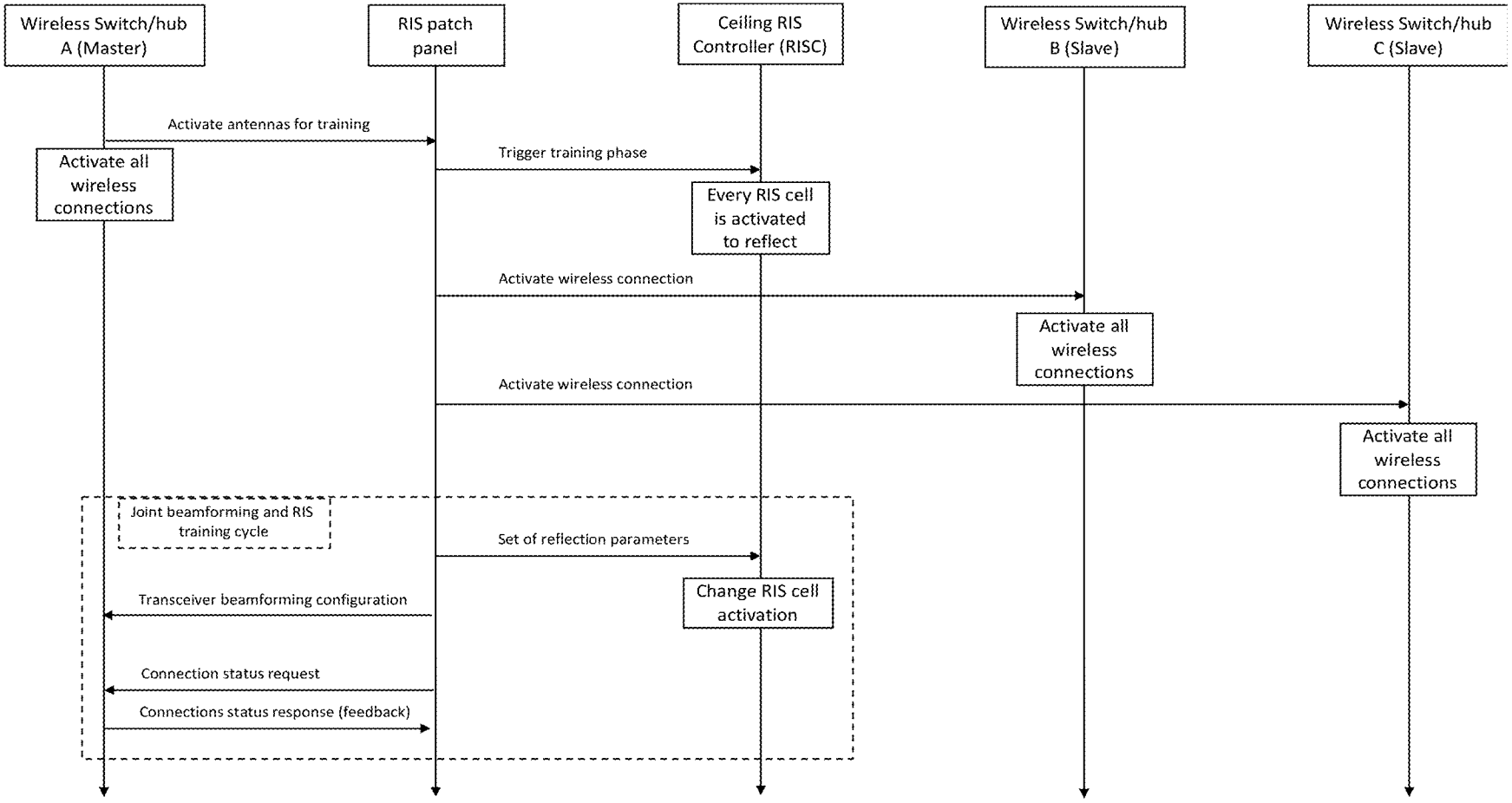
FIG. 7 illustrates a flow diagram of a wall RIS training and control process according to an embodiment.

In another embodiment, e.g., during the intra-rack connection setup a wall RIS training process may be executed. FIG. 7 illustrates a flow diagram of a wall RIS training and control process according to an embodiment. For example, rack servers are required to activate wireless connections so as to become discoverable. In parallel, the Wireless switch issues an activation command to the control device (RIS patch panel) that, in turn, can control the RIS by means of the wall RISC. The beam training cycle is activated based on a machine-learning algorithm that analyzes a set of reflection parameters and determines the connection status by monitoring the feedback obtained from the wireless switch as depicted in FIG. 7.

Once the intra-rack training and control process is finished, rack servers are inter-connected based on a specific configuration. If a server failure occurs or a server needs to be replaced or a new rack server needs to be added, the training process should be executed again.

Figure 8:
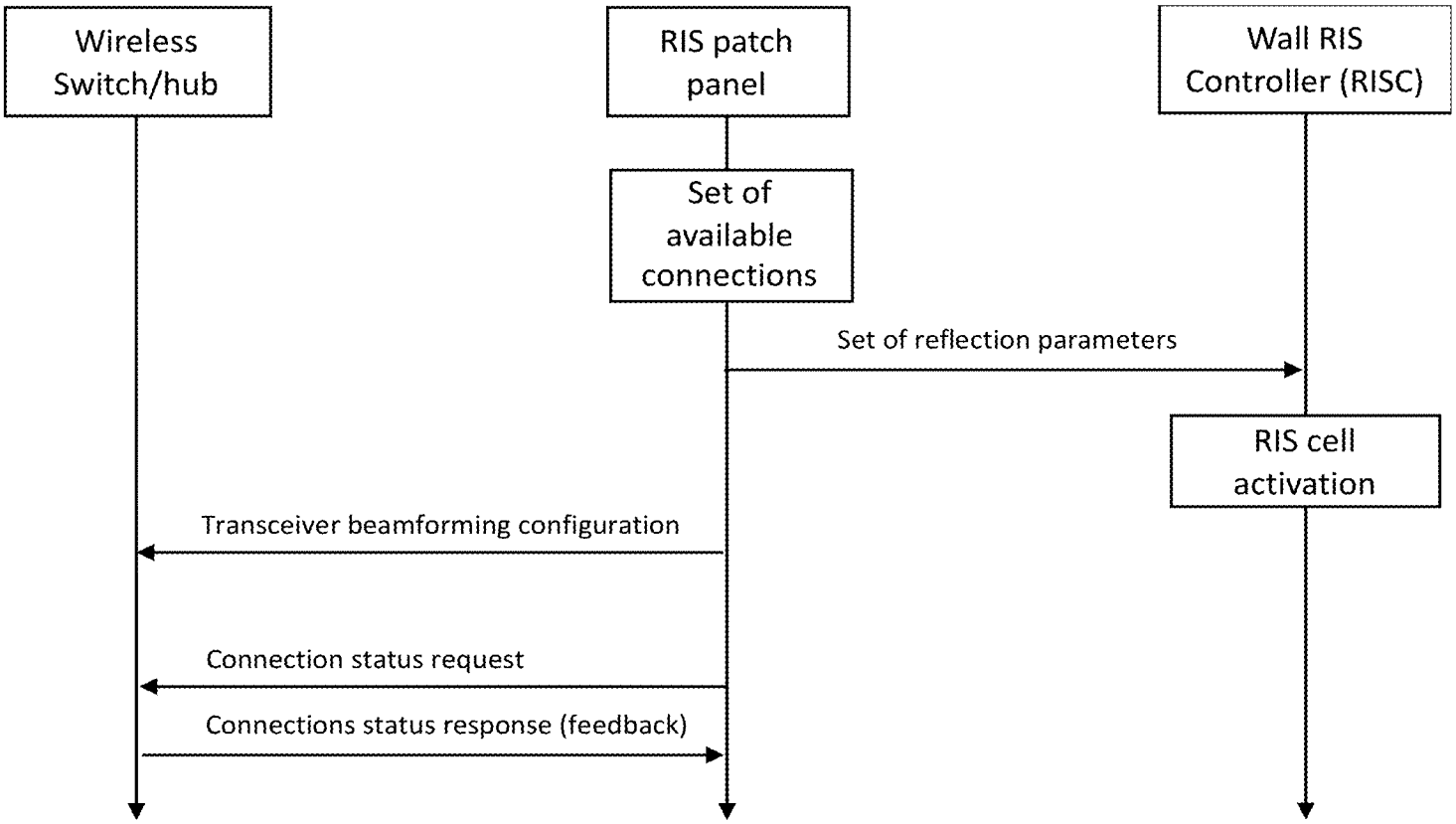
FIG. 8 illustrates a flow diagram of a wall RIS connections management process according to an embodiment.

While running, a new connection configuration may be pushed. FIG. 8 illustrates a flow diagram of a wall RIS connections management process according to an embodiment. For example, a particular connection between two different rack servers may be disabled or a new connection can be established. In this case, the new set of available connections is sent to the control device (RIS patch panel) which may automatically select (based on the previous successful training process) the physical propagation settings (set of reflection parameters) that enable such new set of connections between rack servers. A connection status request may then sent to the Wireless switch, which then checks and replies with a connection status response (which includes connection feedback information).

Figure 9:
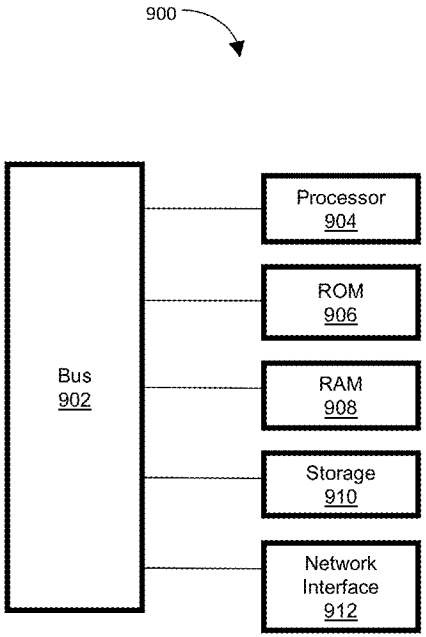
FIG. 9 is a block diagram of a processing system according to an embodiment.

FIG. 9 is a block diagram of a processing system 900 according to an embodiment. The processing system 900 can be used to implement the protocols, devices, mechanisms, systems and methods described above. For example, in an embodiment a control device (e.g., a patch panel) may include a processing system 900. The processing system 900 includes a processor 904, such as a central processing unit (CPU) of a computing device or a distributed processor system. The processor 904 executes processor-executable instructions for performing the functions and methods described above. In embodiments, the processor executable instructions are locally stored or remotely stored and accessed from a non-transitory computer readable medium, such as storage 910, which may be a hard drive, cloud storage, flash drive, etc. Read Only Memory (ROM) 906 includes processor-executable instructions for initializing the processor 904, while the random-access memory (RAM) 908 is the main memory for loading and processing instructions executed by the processor 904. The network interface 912 may connect to a wired network or cellular network and to a local area network or wide area network, such as the Internet, and may be used to receive and/or transmit data, including datasets such as datasets representing one or more RIS configurations and/or beamforming configurations. In certain embodiments, multiple processors perform the functions of processor 904.

Embodiments herein advantageously enable joint configuration of RIS propagation parameters and transceiver beamforming parameters to perform datacenter operations including server failures, topology changes, such as rack movements, server replacements, etc.

Embodiments herein advantageously enable Reconfigurable Intelligent Surfaces (RISs) in datacenters to automatically program inter-rack and intra-rack connections through directive wireless technologies, including mmWave or THz communications.

Embodiments herein advantageously enable AI-based algorithms to execute intra-rack and inter-rack training processes responsible of automatically (without human intervention) selecting the optimal set of propagation and reflection parameters for the RIS jointly with the transceiver beamforming alignment configurations.

The present embodiments advantageously provide methods for dynamically and remotely controlling connections between servers within a data center, for example, when installing RISs on a rear panel of racks and on the ceiling, or when installing a Wireless switch/hub on top of each rack to provide wireless connectivity.

Embodiment herein advantageously enable executing AI-based algorithms to learn propagation parameters to apply on RIS configurations in order to establish connections between rack servers within the same rack or between wireless switches on different racks.

For example, in various embodiments, an AI-based algorithm may be executed on the control device (RIS Patch Panel component), which is connected to the RISC for pushing RIS propagation settings as well as to wireless switches (rack servers) to push transceiver beamforming configurations and to obtain beamforming feedbacks; initial transceiver beamforming configurations and RIS propagation setting may be triggered to start the training phase; the AI-based algorithm starts reducing the solution set to jointly select the optimal RIS setting and transceiver configuration for each wireless switch (rack server); and obtained configurations and settings are pushed and applied to the RIS and wireless switches (rack servers) and the connections are established according to the current datacenter topology.

While embodiments have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A method of dynamically and adaptively controlling connections between a plurality of servers in a data center, the data center including a first reconfigurable intelligent surface (RIS) and a first RIS controller (RISC) configured to control physical propagation settings of physical propagation elements of the first RIS, wherein each server of the plurality of servers includes or is connected with a wireless connection component enabling communication via directive wireless propagation via the physical propagation elements of the first RIS, the method comprising the steps, implemented in a control device, of:

pushing a set of one or more RIS configurations to the RISC to enable the RISC to control physical propagation settings of the physical propagation elements of the RIS according to the one or more RIS configurations;

pushing a set of one or more transceiver beamforming configurations to the wireless connection components to enable control of directive wireless propagation settings of the wireless connection components according to the one or more transceiver beamforming configurations;

receiving connection feedback information from the wireless connection components for each of the one or more RIS configurations combined with each of the one or more transceiver beamforming configurations;

determining an optimal transceiver beamforming configuration and an optimal RIS configuration using the connection feedback information;

pushing the optimal RIS configuration to the RISC to enable the RISC to control the physical propagation settings of the physical propagation elements of the RIS according to the optimal RIS configuration; and pushing the optimal transceiver beamforming configuration to the wireless connection components to control the propagation settings of the wireless connection components according to the optimal transceiver beamforming configuration.

2. The method of claim 1, wherein each wireless connection component includes a set of one or more antenna elements.

3. The method of claim 1, wherein the plurality of physical propagation elements include a plurality of reflective elements, and wherein the physical propagation settings include reflection angles of the plurality of reflective elements.

4. The method of claim 1, wherein each of the plurality of servers is located in a rack, wherein the first RIS is connected with a rear panel of the rack and wherein each server includes one of the wireless connection components.

5. The method of claim 1, wherein the plurality of servers are located in multiple racks, wherein the first RIS is located proximal to the multiple racks and wherein each rack of the multiple racks includes one or more of the plurality of servers, wherein each rack of the multiple racks includes one of the wireless connection components and wherein each of the one or more of the plurality of servers within the rack are communicably connected with the one of the wireless connection components.

6. The method of claim 5, wherein each rack of the multiple racks includes a second RIS and a second RISC configured to control physical propagation settings of physical propagation elements of the second RIS.

7. The method of claim 5, wherein a first one of the wireless connection components acts as a master wireless connection component and the remaining wireless connection components act as slave wireless connection components, wherein the master wireless component includes or is communicably coupled with the control device.

8. The method of claim 1, wherein the pushing a set of one or more RIS configurations to the RISC includes initially pushing an initial RIS configuration wherein all physical propagation elements of the RIS are activated.

9. A controller device in a data center for controlling connections between a plurality of servers in the data center, the data center including a first reconfigurable intelligent surface (RIS) and a first RIS controller (RISC) configured to control physical propagation settings of physical propagation elements of the first RIS, wherein each server of the plurality of servers includes or is connected with a wireless connection component enabling communication via directive wireless propagation via the physical propagation elements of the first RIS, the control element including a memory storing code, which when executed by one or more processors of the controller device, cause the controller device to implement a method comprising:

pushing a set of one or more RIS configurations to the RISC to enable the RISC to control physical propagation settings of the physical propagation elements of the RIS according to the one or more RIS configurations;

pushing a set of one or more transceiver beamforming configurations to the wireless connection components to enable control of directive wireless propagation settings of the wireless connection components according to the one or more transceiver beamforming configurations;

receiving connection feedback information from the wireless connection components for each of the one or more RIS configurations combined with each of the one or more transceiver beamforming configurations;

determining an optimal transceiver beamforming configuration and an optimal RIS configuration using the connection feedback information;

pushing the optimal RIS configuration to the RISC to enable the RISC to control physical propagation settings of the physical propagation elements of the RIS according to the optimal RIS configuration; and pushing the optimal transceiver beamforming configuration to the wireless connection components to control propagation settings of the wireless connection components according to the optimal transceiver beamforming configuration.

10. The controller device of claim 9, wherein each of the plurality of servers is located in a same rack, wherein the first RIS is connected with a rear panel of the rack and wherein each server includes one of the wireless connection components.

11. The controller device of claim 9, wherein the plurality of servers are located in multiple racks, wherein the first RIS is located proximal to the multiple racks and wherein each rack of the multiple racks includes one or more of the plurality of servers, wherein each rack of the multiple racks includes one of the wireless connection components and wherein each of the one or more of the plurality of servers within the rack are communicably connected with the one of the wireless connection components.

12. The controller device of claim 11, wherein each rack of the multiple racks includes a second RIS and a second RISC configured to control physical propagation settings of physical propagation elements of the second RIS.

13. The controller device of claim 11, wherein a first one of the wireless connection components acts as a master wireless connection component and the remaining wireless connection components act as slave wireless connection components, wherein the master wireless component includes or is communicably coupled with the control component.

14. A data center system, comprising:

a plurality of servers;

a reconfigurable intelligent surface (RIS) comprising physical propagation elements;

a RIS controller (RISC) configured to control physical propagation settings of the physical propagation elements of the RIS;

a plurality of wireless connection components, wherein each server of the plurality of servers includes or is connected with one of the plurality of wireless connection components enabling communication via directive wireless propagation via the physical propagation elements of the RIS; and a controller device configured to:

push a set of one or more RIS configurations to the RISC to enable the RISC to control physical propagation settings of the physical propagation elements of the RIS according to the one or more RIS configurations;

push a set of one or more transceiver beamforming configurations to the plurality of wireless connection components to enable control of directive wireless propagation settings of the plurality of wireless connection components according to the one or more transceiver beamforming configurations;

receive connection feedback information from the plurality of wireless connection components for each of the one or more RIS configurations combined with each of the one or more transceiver beamforming configurations;

determine an optimal transceiver beamforming configuration and an optimal RIS configuration using the connection feedback information;

push the optimal RIS configuration to the RISC to enable the RISC to control physical propagation settings of the physical propagation elements of the RIS according to the optimal RIS configuration; and push the optimal transceiver beamforming configuration to the plurality of wireless connection components to control propagation settings of the plurality of wireless connection components according to the optimal transceiver beamforming configuration.

15. The data center system of claim 14, wherein:

each of the plurality of servers is located in a rack, wherein the RIS is connected with a rear panel of the rack and wherein each server includes one of the wireless connection components; or the plurality of servers are located in multiple racks, wherein the RIS is located proximal to the multiple racks and wherein each rack of the multiple racks includes one or more of the plurality of servers, wherein each rack of the multiple racks includes one of the wireless connection components and wherein each of the one or more of the plurality of servers within the rack are communicably connected with the one of the wireless connection components.

* * * * *